US005171009A

United States Patent [19]

Filewich et al.

[11] Patent Number: 5,171,009

[45] Date of Patent: Dec. 15, 1992

[54] BASKETBALL APPARATUS

[75] Inventors: Paul T. Filewich, No. Stonington, Conn.; Richard F. Chipperfield, Charlestown, R.I.

[73] Assignee: E-Z Score Corp., Stonington, Conn.

[21] Appl. No.: 809,403

[22] Filed: Dec. 18, 1991

[51] Int. Cl.[5] ..... A63B 63/08

[52] U.S. Cl. ..... 273/1.5 A

[58] Field of Search ..... 273/1.5 R, 1.5 A, 371, 273/397

[56] References Cited

U.S. PATENT DOCUMENTS

| | | | |
|---|---|---|---|
| 4,013,292 | 3/1977 | Cohen et al. | 273/371 |
| 4,595,199 | 6/1986 | Offutt | 273/1.5 A |
| 4,667,957 | 5/1987 | Joseph | 273/397 X |
| 4,805,917 | 2/1989 | Cochran et al. | 273/397 |
| 4,838,549 | 6/1989 | Woodall | 273/1.5 A |
| 4,904,981 | 2/1990 | Mele et al. | 273/1.5 A X |
| 5,035,423 | 7/1991 | Arginiega | 273/1.5 A |
| 5,074,552 | 12/1991 | Gomez et al. | 273/1.5 A |

OTHER PUBLICATIONS

Korney Board Aids, Basketball Coaching and Training Aids, p. 12, Shoot-A-Way 12-1988.

*Primary Examiner*—Paul E. Shapiro

*Attorney, Agent, or Firm*—Salter, Michaelson & Benson

[57] ABSTRACT

Basketball apparatus that includes a support member, a backboard mounted on the support member, and a hoop mounted on the backboard. The backboard is mounted on the support member for rotation with respect thereto, wherein the backboard is locatable in selected angular positions with respect to a predetermined location that is disposed remote from the support member and the backboard mounted thereon.

A detecting device is mounted at the location remote from the support member for detecting the number of shots taken by a player and is also responsive to a device for indicating successful shots to the hoop, wherein the proficiency of a player in shooting the ball through the hoop is accurately calculated and recorded.

20 Claims, 6 Drawing Sheets

BASKETBALL APPARATUS

BACKGROUND OF THE INVENTION

The present invention relates to basketball apparatus that in one form of the use thereof provides for the automatic return to a player of a basketball that is shot toward a basket by the player, thereby enabling the player to retrieve a basketball without moving from a selected position.

Oftentimes, basketball players wish to improve their shooting skills by devoting additional time only to shooting a ball at a basket, but in the absence of a fellow player, the player who has to practice alone expends an unreasonable amount of time in chasing and retrieving the ball after each shot. Prior to the instant invention, some efforts have been made to provide basketball retrieval apparatus by which a basketball, as shot by a player toward a hoop and backboard, is automatically directed back to the player for re-shooting of the ball. In order to capture the ball for return to the player as it rebounds from the backboard or hoop, some efforts have also been made to incorporate a netting assembly by which the ball is returned directly to the player after bouncing off the backboard or rim and into the netting. In this connection, the Woodall U.S. Pat. No. 4,838,549, and Joseph U.S. Pat. No. 5,016,875, are of interest since they generally disclose this type of apparatus. In the Woodall patent a portable retrieval device is illustrated having a netting arrangement which is located in encircling relation around the backboard, the netting directing the rebounded ball to a return chute which returns the ball to the player located at the outermost end of the chute. In the Woodall patent, the device is also movable on a wheeled frame to various locations relative to the backboard, so as to provide for different angle shots for the player thereby simulating shot situations found in the actual play of the game. Although the Woodall device provides for the capture of the ball after each shot, the entrance-way to the basket is obscured, and a simulated angle shot can only be accomplished by physically moving the apparatus relative to the backboard, which requires more time and effort than that required for the player to actually retrieve the ball in the normal practice routine.

The U.S. Patent to Joseph also discloses a portable basketball retrieval device which includes a netting assembly that is disposed adjacent to a backboard that is supported at the uppermost end of the frame of the device. Although the Joseph netting assembly directs a ball that rebounds from the backboard into a return chute, at the end of which a player is positioned for replay of the ball, the netting obscures the view to the basket, and since the Joseph apparatus is portable and has the backboard mounted thereon, the player cannot make simulated angle shots.

Other U.S. Patents have also been granted on various types of basketball retrieval devices, none of which are relevant with respect to the subject invention. These McNab U.S. Pat. No. 3,776,550; Caveney U.S. Pat. No. 3,902,506; Cohen U.S. Pat. No. 4,291,885; Joseph U.S. Pat. No. 4,667,957; Postol U.S. Pat. No. 4,786,371; Coleman U.S. Pat. No. 4,896,882; Jacobs U.S. Pat. No. 4,913,431; and Goldfarb U.S. Pat. No. 4,955,605.

As will be described hereinafter, the basketball apparatus of the subject invention is uniquely different from the devices illustrated in the aforesaid U.S. Patents, and basically is distinguishable therefrom by providing for the rotatable movement of the backboard that is mounted on a support. Thus, the rotatable movement of the backboard relative to its support enables a player to simulate various angular positions, and different angle shots, that would be experienced in the actual play of the game.

SUMMARY OF THE INVENTION

The present invention relates to a basketball apparatus that enables a player to practice the shooting of a basketball wherein the basketball is automatically returned to the player at a selected location; and in one form of the invention the apparatus is convertible from a practice mode to a playing mode and then back to the practice mode by a simple manipulation of the components of the apparatus. Basically, the apparatus includes a vertical support member, a backboard mounted on the support member for selective rotation with respect thereto, and a hoop assembly that is normally mounted on the backboard. Thus, the backboard is rotatably moved to selected angular positions as mounted on the support member with respect to a predetermined location that is disposed remote from the support member.

When the apparatus is located in the practice mode a cage assembly surrounds the backboard and hoop, and is open at the front and top thereof, providing for visual contact, and playing access to the hoop. The cage assembly and a screen secured thereto also envelopes a return mechanism that includes an adjustable return chute and ramp, the cage assembly and screen capturing the basketball after it is deflected from the backboard or hoop for directing the ball to the return chute and ramp which returns the ball to the player located at the outermost end of the ramp. The entire apparatus in the form of the invention when used as a practice device is portable and is movable to various locations as desired, and is also constructed so as to be foldable into a storage position.

A feature of the invention is the use of special electronic devices that will count the number of shots taken from a specific location by a player and the number of successful baskets recorded, the data as collected then being utilized to arrive at a player's profile of proficiency at various selected positions that are located remote from the backboard.

Accordingly, it is an object of the present invention to provide a basketball retrieval apparatus that includes a support member on which a backboard assembly is mounted, wherein a player is able to practice shooting basketballs from a specified station remote from the backboard assembly without moving from the station. The backboard assembly, which includes a backboard and a hoop that is fixed thereto, is rotatable to an infinite number of angular positions relative to the support so as to enable the player located at the station to practice shooting the basketball from various angular positions of the backboard that simulate angle shots which would normally be experienced by a player in the actual play of the game, the number of shots made from selected locations being recorded for compiling a record of proficiency for a player at the selected locations.

Still another object is to provide a basketball apparatus having a support on which a backboard, having a hoop secured thereto, is movable from a position wherein the hoop is initially co-axial with the support member to define a practice position, and that is movable 180° relative to the support member, wherein the hoop is then located in nonaxial alignment with the support member, thereby providing for the safe use of the apparatus in the actual play of the game.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
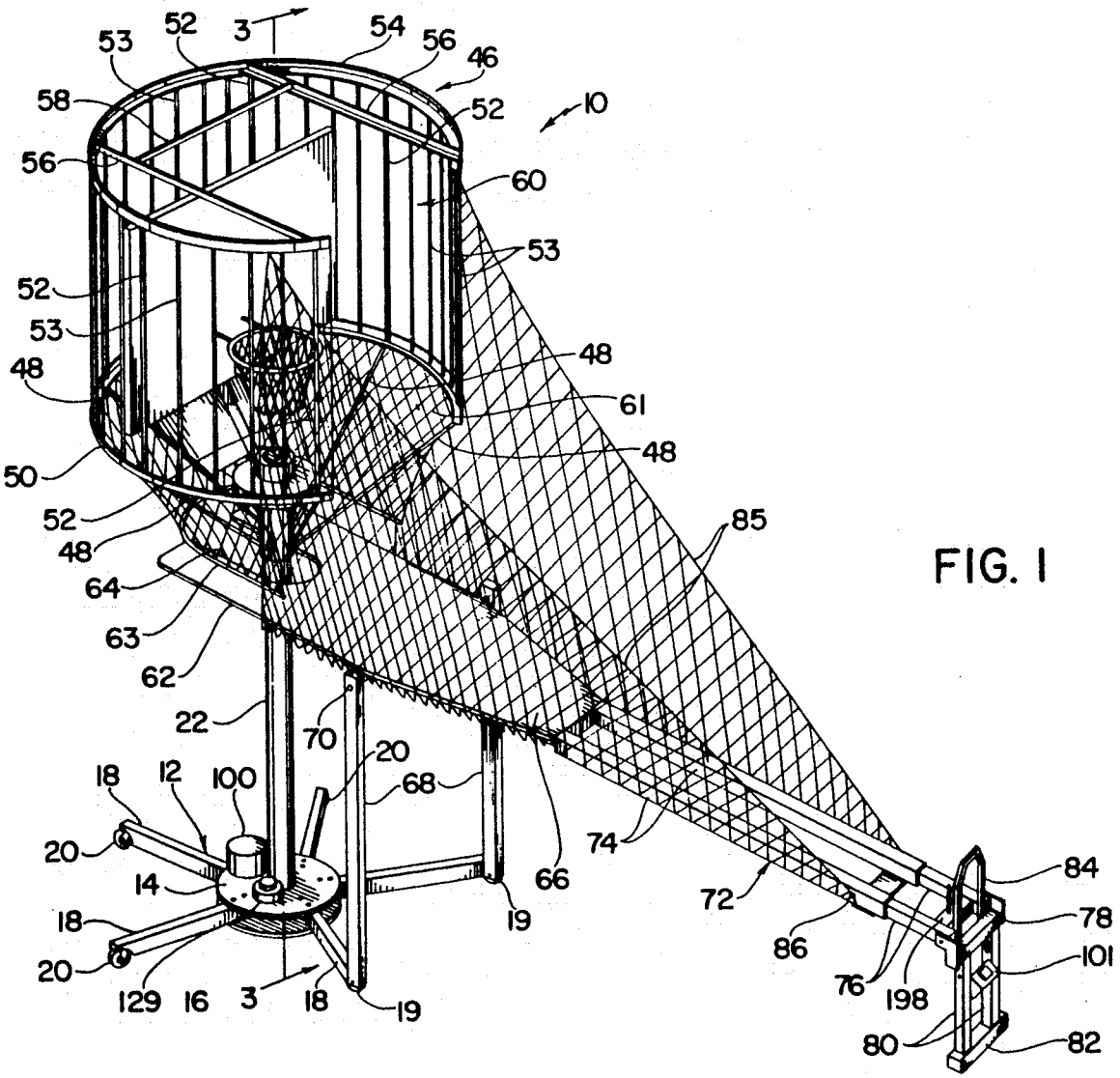
FIG. 1 is a perspective view of the basketball apparatus as embodied in the subject invention, in which a portable screen assembly and basketball retrieval device are shown in the position of use.
Figures 2, 4:
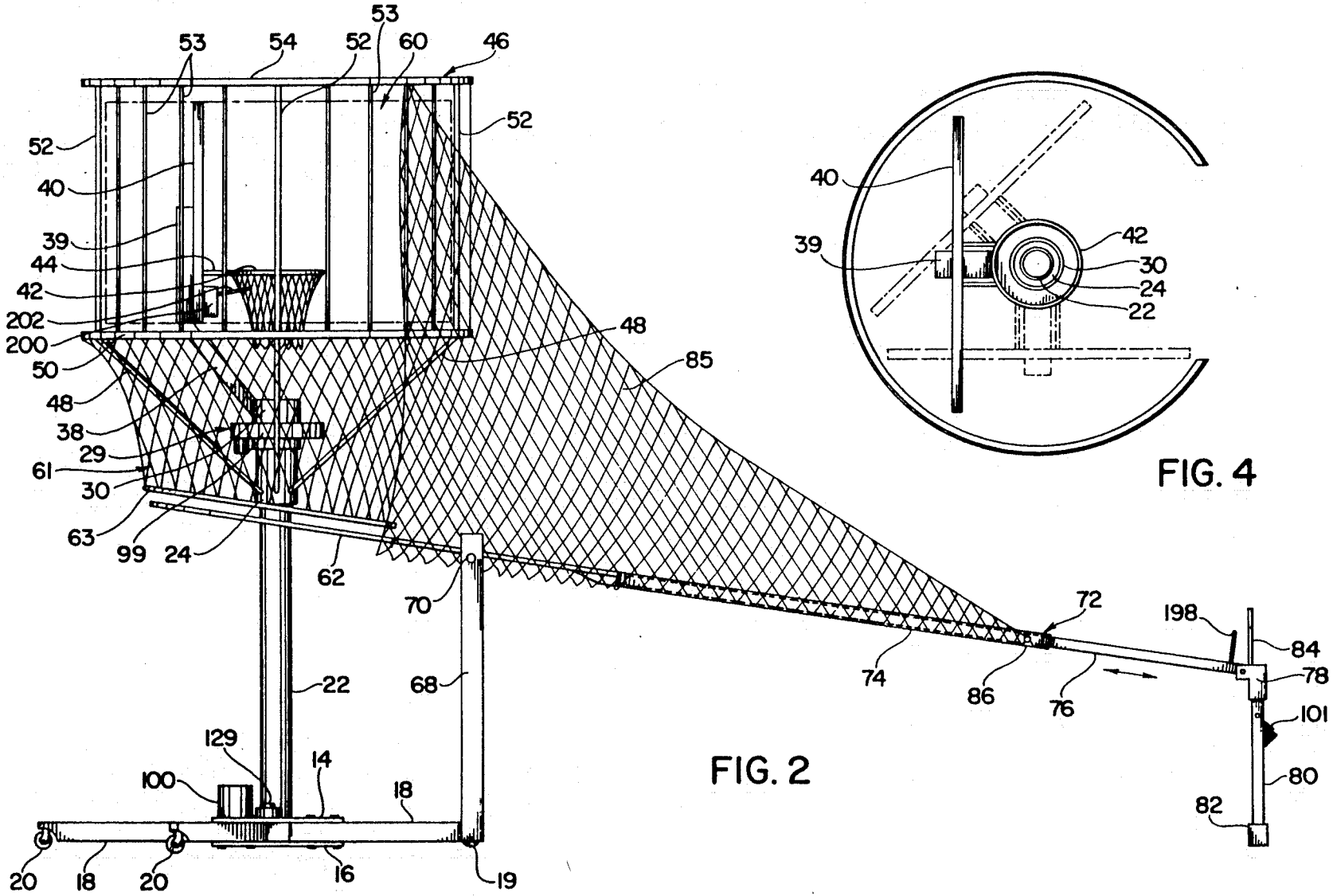
FIG. 2 is a side elevational view thereof.
FIG. 4 is a top plan view of a cage as it surrounds a backboard and support member, and illustrates in phantom representations of different angular locations of the backboard when the apparatus is disposed in the practice mode.

Referring now to the drawings, and particularly to FIGS. 1 and 2, the basketball apparatus as embodied in the present invention is illustrated and is generally indicated at 10. In the preferred form of the invention, the basketball apparatus 10 is used for practice purposes and, as will be described, includes a construction that incorporates a cage member that envelopes a chute and ramp assembly that provides for the return of a basketball to a player located at a selected position that is remote from a backboard and hoop which enables the player to shoot the basketball toward the backboard and hoop, and have the ball automatically returned to the original shooting location. As will also be further described, the angle of the backboard may be infinitely varied so that the player shooting from the same location can be exposed to different angular positions of the backboard wherein angle shots experienced in the actual play of the game can be simulated.

As shown in FIGS. 1 and 2, the basketball apparatus 10 includes a base assembly generally indicated at 12 that includes spaced base plates 14 and 16, between which are bolted a plurality of diverging legs 18. The legs 18 are preferably bolted in place at the inner ends thereof between the plates 14 and 16, and located at the outermost ends of the legs 18 are wheels 19 and locking casters 20 that provide for portability of the basketball apparatus 10, as will be described. Although not illustrated, the casters 20 are of the type that are lockable in place so that the apparatus may be maintained at any specific location in a fixed position. Extending through an opening in the upper plate 14, and locked between the plates 14 and 16, is a vertically extending mast or support member 22 that cooperates with the base plates 14 and 16, and legs 18, to support the upper structure of the basketball practice apparatus 10.

Figure 3:
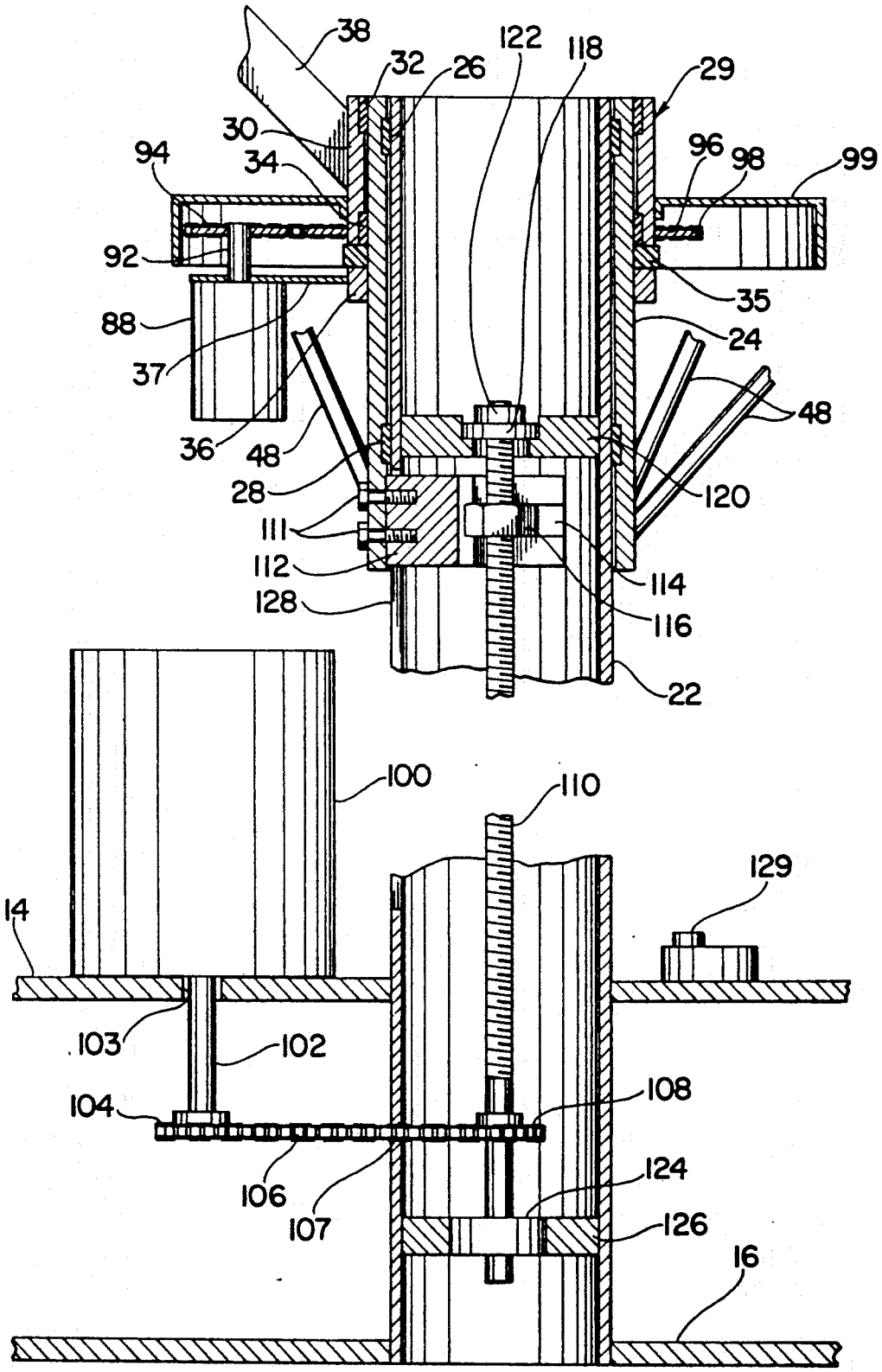
FIG. 3 is a sectional view of the support member of the basketball apparatus illustrating a first adjustment means for effecting rotating movement of the backboard, and a second adjustment means for effecting the vertical movement of the backboard, a screen assembly, and a retrieval mechanism to a folded storage position.

Referring now to FIG. 3, the mast or support member 22 is illustrated in more detail, and as shown, an upper tubular slide member 24 is mounted in encircling engagement on the vertical support member 22 and is movable in a vertical direction relative thereto. For this purpose, an upper bearing 26, and a spaced lower bearing 28, are fixed in the interior surface of the tubular slide member for engagement with the support member 22, so as to enable the tubular slide member to be slidably moved in a vertical direction with respect to the support member 22. As will be described, the tubular slide member 24 is moved downwardly with respect to the support member 22 when the basketball apparatus 10 is to be located in the storage, or collapsed, position thereof.

Mounted on the uppermost end of tubular slide member 24 is a turret assembly generally indicated at 29 that includes a collar 30, which has bearings 32 and 34 fixed interiorly thereof that provide for rotation of the turret 29 with respect to the tubular slide member 24. A ring 35 which defines a thrust bearing is mounted on the tubular slide member 24 in fixed position, and defines a stop or rest for the collar 30, and prevents the downward movement thereof relative to the tubular slide member 24. A second ring 36 is fixed to the slide member 24 beneath the ring 35 and has a plate 37 joined thereto, the purpose of which will be hereinafter described. Joined to the upper end of the collar 30 of the turret assembly 29, is a support arm 38 that extends upwardly at an angle with respect thereto. As shown in FIG. 2, a vertically extending mounting bracket 39 is joined to the uppermost end of the support arm 38, and has a backboard 40 mounted on the front face thereof. The backboard 40 is formed of any conventional material and configuration, and has a hoop 42 secured thereto through a conventional bracket 44. The hoop 42 has the usual net suspended therefrom, the hoop 42 hereinafter designating the hoop and net assembly. The hoop 42 is normally disposed in co-axial relation vertically above the support member 22, and as will be described, in the use of the apparatus 10 for practice purposes the backboard 40 is rotatably moved with the support arm 38, and the turret 29, relative to the support member 22, to locate the plane of the backboard 40 in a infinite number of angular positions with respect to a fixed location from which a player would direct a basketball in practice shooting at the backboard 40 and hoop 42. Thus, the player who is positioned at a single location may have the backboard adjustably moved to simulate angular positions that are experienced during the actual play of a game.

One of the purposes of the subject invention is to provide a practice device that will enable an individual player to shoot baskets, and have the ball returned to him at a fixed location. Thus, the player will not have to devote time and energy to chasing and retrieving the ball after each shot. For the purpose of returning the ball to the player at a fixed location, a cage assembly generally indicated at 46 is provided, and as shown in Figs. I and 2, the cage assembly 46 envelopes the backboard 40 and hoop 42 and, as will be described, acts to capture the ball as it is deflected from the backboard and hoop for return to the player. As shown, the cage assembly 46 is defined by a plurality of frame members that include lower inclined support rods 48, the lower ends of which are fixed in appropriate openings as formed in the tubular slide member 24. The uppermost ends of the support rods 48 are secured to a generally circular lower support ring 50, the lower support ring 50 being generally disposed in a horizontal plane and, as shown in FIG. 1, having an opening that is formed between the spaced free ends thereof. The configuration of the lower support ring 50, and the inclined support rods 48, define a generally inverted cone-like configuration, or funnel, that will direct a ball falling therethrough to a ball return assembly located below the cage assembly 46. It is understood that the support rods 48 are sufficiently spaced from each other to provide for the passage of a basketball therethrough.

Joined to the lower ring 50, and extending upwardly therefrom, are a plurality of vertical cage elements 52 and vertical wires 53 located between the cage elements 52. The cage elements 52 and vertical wires 53 are secured at their uppermost ends to an upper ring 54 that has a configuration similar to that of the lower ring 50, the upper ring 54 also having spaced free ends that define an opening therebetween. Joined to the upper ring 54 are parallel horizontal struts 56 that are interconnected by a horizontal cross bar 58, the cross bar 58 being located above the backboard but offset rearwardly with respect thereto. The rings 50 and 54 cooperate with the vertical cage elements 52, the vertical wires 53, the horizontal struts 56, and cross bar 58 to define an upper screen structure of the cage assembly 46 that is generally indicated at 60 and that, as illustrated, is generally cylindrical in configuration, and that is disposed in surrounding relation with respect to the backboard 40 and hoop 42. Extending below the upper screen structure 60 of the cage assembly 46 for securement to a horseshoe-shaped rod 63, is a lower screen structure generally indicated at 61. The lower screen structure 61 of the cage assembly 46, which includes the lower inclined support rods 48 and a screen-like material secured thereto has a funnel-like configuration and receives the basketball from the upper screen structure 60 as deflected from the backboard 40 and hoop 42, the ball dropping downwardly between the inclined support rods 48 onto a chute and ramp assembly for return to the player as will be described. The space between the front vertical elements 52 of the upper screen structure 60 of the cage assembly 46 is free of the vertical wires or screen material and provides clear visual and shooting access to the backboard and hoop.

Referring again to FIG. 1, the construction for receiving the ball that is captured within the cage assembly 46 is more particularly illustrated, and includes a paddle-like chute 62 that is formed at the innermost end, with a slot 64 that provides for location of the paddle-like chute 62 around the vertical support member 22. The paddle-like chute 62 has a relatively narrow and elongated configuration, and tapers from the end in which the slot 64 is formed to an outer reduced end 66. The chute 62 is pivotally mounted on spaced vertical beams 68 that are secured to the uppermost ends of two of the spaced legs 18, as shown in FIG. 1. An axle 70 is fixed to the underside of the paddle-like chute 62, the opposed ends of the axle 70 extending into appropriate openings as formed in the vertical beams 68 adjacent to the upper ends thereof, the chute 62 thereby being pivotally mounted on the vertical beams 68. Pivotally connected to the outermost end 66 of the chute 62 is a ramp, generally indicated at 72, that is defined by a first pair of elongated parallel tubes 74 that have a square-shaped cross-sectional configuration. Telescopingly received in the elongated tubes 74 are a second set of tubes 76, on the outermost ends of which an end member 78 is mounted for pivotal movement. Support legs 80 are fixed in the end member 78, and extend downwardly therefrom, and have a foot portion 82 joined to the lowermost end thereof. The legs 80 and foot portion 82, together with the end member 78, are pivotally movable relative to the tubes 76 when the ramp 72 is to be moved to a storage position thereof, as will be described. A ball stop 84 in the form of a modified U-shaped bail is pivotally mounted on the legs 80, and is normally located in an upstanding position, as shown in FIGS. 1 and 2, for receiving a ball thereagainst that is directed thereto by the chute 62 and the ramp 72. The tubes 76, which are telescopically received in the tubes 74, are movable inwardly and outwardly relative thereto to locate the outermost ends of the ramp 72 and the ball stop 84 in a desired location relative to the backboard, so as to enable a person who is utilizing the apparatus to select a variety of distances from the backboard for the purpose of practicing shooting skills.

As indicated above, an upper screen structure 60 is mounted on the framework of the cage assembly 46 for enclosing the backboard 40 and hoop 42, in order to further prevent a ball that is shot toward the backboard and hoop from bouncing outwardly therefrom. As described, the lower screen structure 61 is secured to the lower support ring 50, and to the horseshoe-shaped lower rod 63. Extending forwardly of the cage assembly 46 are spaced apart screen side extensions 85, preferably in the form of a netting, which are secured to the ring 54, chute 62, and ramp 72, terminating at L-shaped end clips 86 that are secured to the sides of the tubes 74 of the ramp 72 (FIG. 2). It is seen that the screen structures 60 and 61, and the spaced apart side extensions 85, substantially enclose the cage assembly 46, the paddle-like chute 62, and the ramp 72, but provide open access between the extension 85 to the backboard 40 and hoop 42, through the openings at the front and top of the cage assembly 46 that permit a player to have clear visual and shooting access to the backboard 40 and the hoop 42. However, since the screen structures 60 and 61 and side extensions 85 effectively enclose the cage assembly 46 and the sides of the apparatus from the outermost end of the chute 72 to the cage assembly, a ball which is deflected or that drops from the backboard or hoop will fall downwardly through the funnel-shaped lower portion of the cage onto the chute 62, and is then directed onto the ramp 72 toward the ball stop 84. A player located adjacent to the ball stop 84 at the outermost end of the apparatus 10 will then have easy access to the basketball for repetitive shooting without having to chase and retrieve the ball.

In use of the apparatus as described, a player located at the outermost end of the ramp 72 may on occasion wish to practice corner shots, or shots wherein the backboard is disposed at an angle In order to provide this kind of practice shooting and still enable the player to be located at a set position determined by the outermost end of the ramp 72. a control device is provided for rotating the backboard to a desired angular position relative to the player. Referring again to FIG. 3, the tubular slide member 24 is shown including a control motor 88, preferably a stepping motor, that is mounted on the plate 37, that is in turn secured to the ring 36. Extending upwardly from the motor 88 and through the plate 37 is a motor shaft 92, on the uppermost end of which a sprocket gear 94 is secured. Mounted in encircling relation on the collar 30 of the turret 29 for rotation therewith, is a sprocket gear 96 that is engaged by a sprocket chain 98, that also engages the sprocket gear 94. Thus, rotation of the shaft 92 of the motor 88 will produce a corresponding rotation of the gear 94, and the relative rotation of the gear 96 and the collar 30 attached thereto as determined by the gear ratio between the gears 94 and 96. Mounted on the collar 30 and fixed thereto is a turret housing 99 that encloses the gears 94, 96, and a chain 98, and provides protection therefor. Since the turret collar 30 is interconnected to the bracket 39 and backboard 40 through the arm 38, the rotation of the collar 30 by operation of the motor 88 will produce a desired rotary movement of the collar, and a corresponding rotary movement of the arm 38 and backboard 40, and the hoop 42 attached thereto. As the backboard 40 rotates, the hoop 42 maintains a co-axial relationship with the support member 22. Therefore, when the backboard 40 is moved to a selected angular position relative to the outermost end of the ramp 72, a player located adjacent to the end of the chute 72 will then have an angle shot to the backboard 40, while the hoop 42 retains its co-axial relation with the support member 22. It is understood that the backboard 40 as illustrated in FIGS. 1, 2 and 4, may be rotated a full 90° to present a corner shot for the player, and then rotated 180° to present the opposite corner shot for the player while the player maintains a constant position at the outer end of the ramp 72. Obviously, any angular position that the player will encounter in the actual play of the game relative to the backboard 40 and the hoop 42 can be replicated by simply rotating the backboard 40 relative to the player who is located adjacent to the outermost end of the ramp 72. Examples of different angular positions that are possible by rotating the backboard are illustrated in phantom in FIG. 4. A control panel 101 electrically connected to the adjustment stepping motor 88 is mounted o the legs 80 and is located at the outer end of the ramp 72. The control panel 101 is provided with an adjustment control switch that upon actuation will cause the motor 88 to rotate in step-by-step relation in a desired direction that will cause the backboard 40 to move to the desired angular position.

In use with the basketball backboard 40, assembled as described and illustrated in FIGS. 1 and 2, the player who wishes to utilize the apparatus will extend the ramp 72 to a suitable location, the telescopic tubes 76 being moved outwardly, relative to the tubes 74, to the desired position. The player who wishes to use the apparatus directs o shoots the basketball toward the backboard 40, and/or hoop 42, the opening at the front of the cage assembly 46 and at the top thereof that is free of wiring or netting providing for a clear view of the hoop 42. When the ball strikes the backboard or hoop and falls through the net attached to the hoop, or rebounds from the backboard or hoop, it is confined within the screen assemblies 60, 61 and 85, and will fall downwardly into the funnel-like lower portion of the cage assembly 46 located at the lower end thereof, thereafter being directed between the inclined rods 48, and onto the chute 62. Since the chute 62 is inclined, the ball will then roll by gravity onto the ramp 72 for return to the player as it rolls into engagement with the ball stop 84. As described, the backboard may be rotated by actuating the switch 101 that causes the control motor 88 to rotate to move the backboard 40 to any desired angular position, with respect to the position of the player at the end of the ramp 72, thereby providing a shot that is angular with respect to the backboard, and thereby simulating shots that are encountered during the actual play of the game. In all positions of the apparatus, the player who will be stationed at the outermost end of the ramp 72 will have a clear view of the basket and backboard, since the cage assembly 46 is open at the front and top thereof. It is also understood that a player ma shoot basketballs at the backboard and/or hoop in rapid succession, thereby using several balls. The apparatus would retrieve and return all of the balls to the outer end of the ramp 72 for access to the player for replay as desired.

Figure 5:
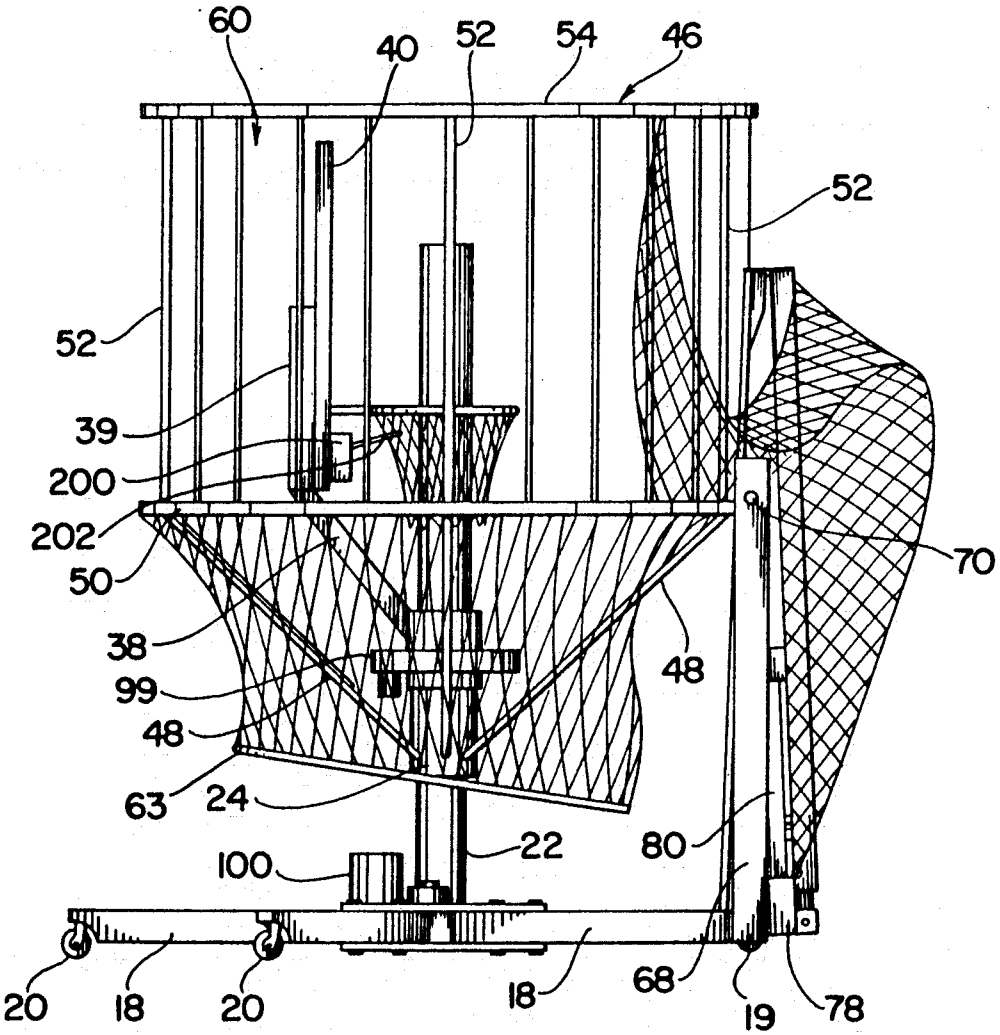
FIG. 5 is a side elevational view of the apparatus when it is moved to the folded storage position.

Because of the manner of use of the apparatus 10, it is desirable on occasion to move it to a storage location, and for this purpose the wheels 19 and casters 20, on the legs 18, at the base of the apparatus are provided. Before the casters 20 are unlocked, the tubular slide member 24, the turret assembly 29, the backboard assembly 40, and the cage assembly 46 as mounted thereon, are all moved downwardly relative to the support member 22 to a collapsed position as illustrated in FIG. 5. In order to move the slide member 24 to the collapsed or storage position, reference is now made to FIG. 3, which illustrates the device for producing the vertical movement of the slide member 24.

As shown in FIG. 3, a drive motor 100 is mounted on the upper plate 14 that is located at the base of the apparatus. Extending downwardly through an appropriate opening 103 formed in the plate 14 is a motor shaft 102, on the lowermost end of which a sprocket gear 104 is secured. A chain 106 engages the sprocket gear 104, and extends through an opening 107 formed in the wall of the support member 22 for engagement with a torque limiting sprocket gear 108, that is secured to an elongated threaded spindle 110 disposed interiorly of the support member 22. Also located interiorly of the support member 22, and secured by bolts 111 to the tubular slide member 24 for movement therewith, is a slide block 112. The slide block 112 is provided with an interior slot 114 in which a nut 116 is fixed, the spindle 110 threadably engaging the nut 116, as shown in FIG. 3. The uppermost end of the spindle 110 extends through an upper bearing 118 that is secured in a bearing holder 120 by a lock nut 122, the bearing holder 120 being fixed to the inner surface of the support member 22. The lowermost end of the spindle 110 extends through a lower bearing 124 that is secured in a lower bearing holder 126, which is fixed interiorly of the support member 22. Since the slide block 112 is secured to the tubular slide member 24, the tubular slide member 24 is slidably movable on the support member 22 as the spindle 110 is rotated by the motor 100. A slot 128 is formed in the wall of the support member 22, and provides for the limit of movement of the slide block 112 as it is moved vertically with respect to the support member 22. It is seen that the vertical movement of the tubular slide member 24, as produced by the operation of the motor 100 and the rotation of the spindle 110, causes the turret assembly 29 that includes the collar 30, the arm 38, the backboard 40, and the cage assembly 46, to move vertically in accordance with the movement of the tubular slide member 24.

Prior to moving the slide member 24 downwardly to a storage position, the side extensions 85 that are attached to the upper frame element of the cage assembly 46 and that extend beyond the cage assembly are disconnected from the chute 62. As shown in FIG. 5, the chute 62 is also pivotally moved to a vertical position between the beams 68, the ramp 72 being pivotally moved with respect to the chute 62 after the legs 80 and the ball stop 84 have been folded to an inactive position. Thus, with the chute 62 removed from its position below the cage assembly 46 and folded together with the ramp 72, as illustrated in FIG. 5, the motor 100 can then be energized by the actuation of a switch 129 that is electrically connected to the motor 100 and that is mounted on the plate 14 to rotate the spindle 110 to move the tubular slide member 24 downwardly with respect to the support member 22, thereby carrying the cage assembly 46, and the backboard 40, and hoop 42 therewith to the storage position. Thereafter, the casters 20 of the lower support assembly for the apparatus are unlocked, and the unit is easily rolled to a remote storage position.

Figure 6:
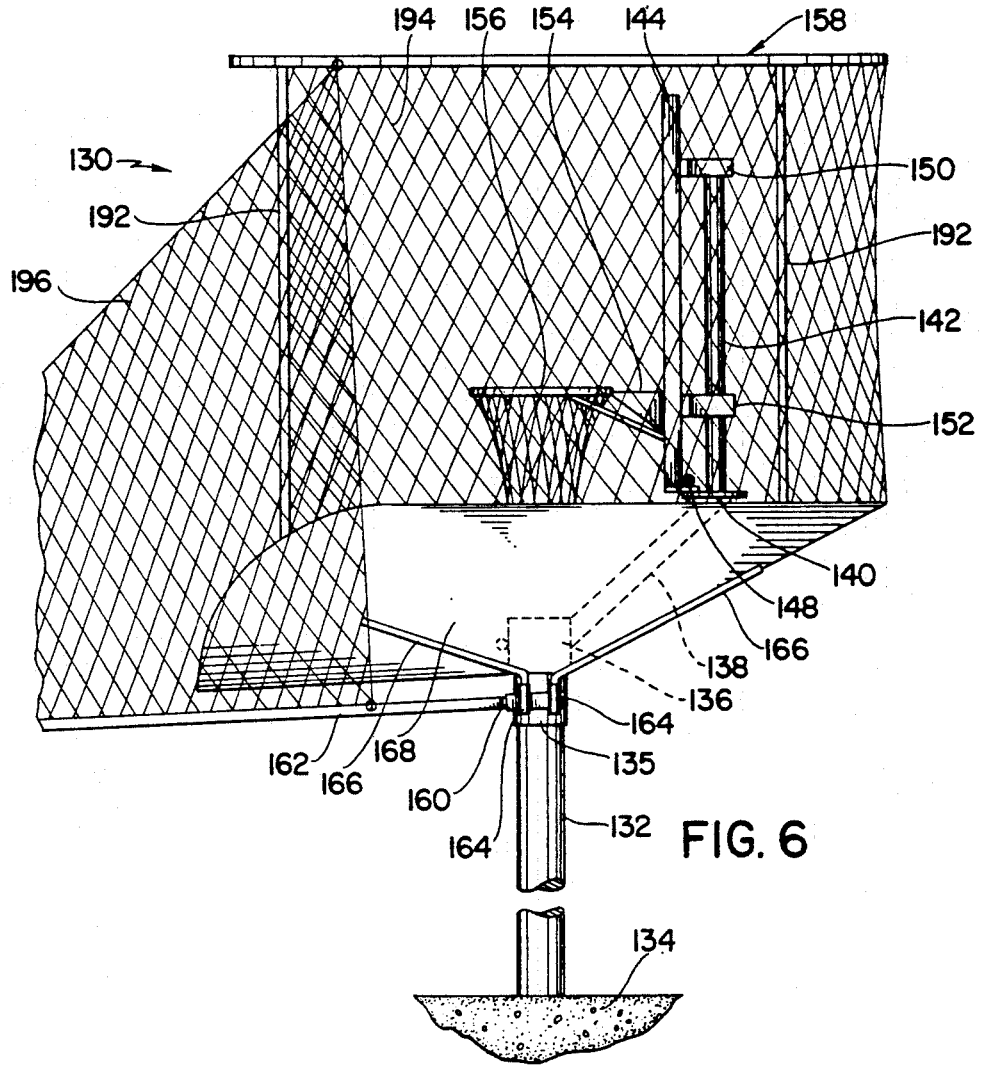
FIG. 6 is a side elevational view of a modification of the invention when used as a practice device, wherein the backboard is shown mounted on a fixed support for rotatable movement with respect thereto, a cage assembly that is used to retrieve a basketball as deflected thereto by the backboard is shown enveloping the backboard and a chute member.
Figure 7:
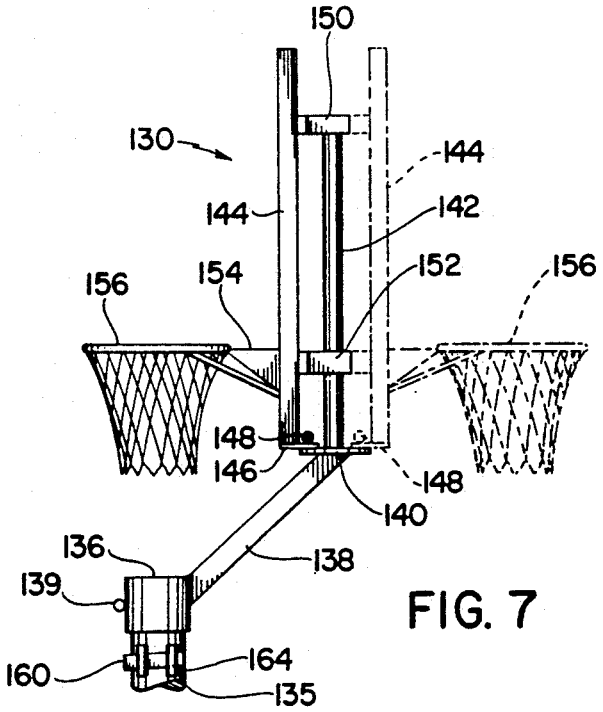
FIG. 7 is a partial elevational view of the backboard and hoop as shown in FIG. 6 with the cage and screen assembly removed, and further illustrates in phantom the position of the backboard and hoop when moved from the practice position to a play position.
Figure 8:
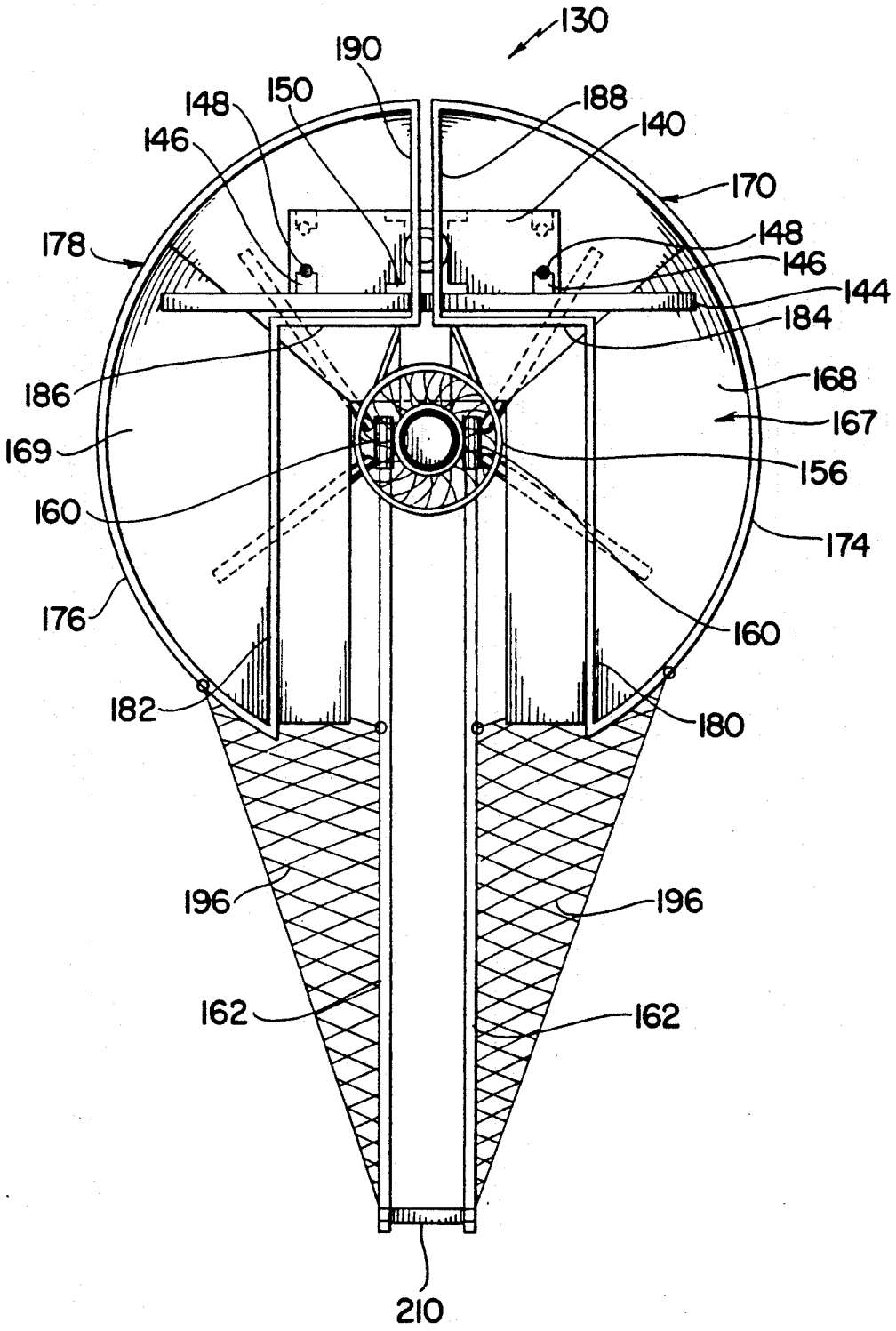
FIG. 8 is a top plan view of the modification of the invention as illustrated in FIG. 6.

Referring now to FIGS. 6, 7, and 8, a modified form of the basketball apparatus is illustrated and is generally indicated at 130. The apparatus 130 is intended for use as a permanent installation and in this connection, includes a post or vertical support member 132 that is fixed in a ground or floor area indicated at 134. Mounted on the uppermost end of the support member 132 in fixed relation thereon is a support sleeve 135. Mounted on the support sleeve 135 in rotating relation thereon is a cap 136 to which an arm 138 is fixed, the arm 138 extending in inclined relation with respect to the cap 136. A lock screw 139 projects into the cap 136 for engagement with the support sleeve 135, for locking the cap 136 and the arm 138 as joined thereto in a fixed position. It is understood that when it is desired to rotate the cap 136, the lock screw 139 is removed from the inserted position as shown. Mounted on the uppermost end of the arm 138 is a plate 140, to which an upstanding post 142 is secured. As shown in FIGS. 7 and 8, a backboard 144 having spaced lower brackets 146 joined thereto is locked to the plate 140 by mean of lock pins 148 that engage the brackets 146. Vertically spaced gudgeons 150 and 152 having bushings located therein are secured to the rear of the backboard 144, the bushings receiving the post 142 therein to provide for rotating movement of the backboard with respect thereto. Mounted on the front side of the backboard 144 by a conventional bracket 154 is a hoop 156, the vertical axis of which, as shown in FIGS. 6 and 7, is co-axial with the vertical axis of the support member 132.

As illustrated in FIGS. 6 and 8, the backboard 144 and the hoop 156 mounted thereon are normally enclosed in a cage assembly generally indicated at 158 when the apparatus is utilized for practice purposes, as described above in connection with FIGS. 1-5. The form of the cage assembly 158 differs somewhat from the cage assembly 46 as illustrated in FIGS. 1 and 2, and includes substantially horizontally slightly extending spaced apart shortened tubular sockets 160 that are welded to the support sleeve 135, and in which elongated, spaced-apart bars 162 are received. As will be described, the spaced-apart bars 162 define a ramp for directing a basketball that falls thereon to the outermost end thereof. Mounted on the tubular sockets 160 and extending in a vertical direction are a plurality of shortened holder sockets 164, the holder sockets 164 receiving the bent lowermost ends of spaced inclined support elements 166 that support a chute generally indicated at 167 that is defined by two dish-like complimentary chute members 168 and 169 that are disposed beneath the backboard 144 and the hoop 156. The chute members 168 and 169 are preferably formed of any suitable plastic material, but can be fabricated of a lightweight metallic material that is deformable for being received on the support elements 166 in a fixed position as by suitable fasteners. As shown more clearly in FIG. 8, the cage assembly 158 includes upper cage elements generally indicated at 170 and 178, the configuration of which provides for an opening at the top of the cage, and at the forward portion thereof. As shown, the upper cage members 170 and 178 include circular portions 174 and 176, respectively, to the front edge of which are joined interior straight portions 180 and 182, respectively. Straight inwardly directed portions 184 and 186 are joined to the portions 180 and 182, respectively, and are secured to the circular portions 174 and 176 through rearwardly extending portions 188 and 190, respectively. As shown in FIG. 6, vertical elements 192 are joined to the upper cage members 170 and 178, and extend downwardly for securement to the chute members 168 and 169, which are fixed to the inclined support elements 166. It is also contemplated to form the vertical elements 192, and the other elements that define the cage assembly 158, of any suitable plastic or other lightweight material. As illustrated in FIG. 8, the longitudinally extending spaced ramp members 162 extend outwardly from the tubular sockets 160 that are joined to the support sleeve 135, the ramp members 162 being fixed at the outer end thereof by a bracket 210 in spaced apart relation so as to accommodate a basketball in rolling relation thereon. Although not shown specifically, a ball stop may be located at the outermost end of the ramp members 162 for receiving a basketball thereagainst after it falls from the chute 167 onto the spaced ramp members 162.

Secured to the upper cage elements 170 and 178, chute members 168 and 169, and to the vertical elements 192 are screen assemblies 194 that envelop each half of the cage assembly 158, the screen assemblies 194 including forward extensions 196 that are secured to the outer edges of the ramp members 162. It is understood that the screen assemblies 194 and the extensions 196 are retained in place thereon by suitable fasteners. It is seen that as a basketball is shot by a player who is located at the outermost end of the ramp members 162 toward the backboard 144 and the hoop 156, the ball will be deflected therefrom downwardly onto the chute 167 which acts as a receiver, and since the chute 167 has a generally inclined configuration toward the ramp members 162, the ball will be directed thereto for return to the player located at the end of the ramp members.

Since the form of the invention as illustrated in FIGS. 6-8 includes a fixed support member 132, it may be desirable to utilize the backboard 144 and hoop 156 in the actual play of the game. For this purpose, the ramp members 162 and the forward net extensions 196 associated therewith, together with the cage assembly 158 that is fixed to the support sleeve 135 through the sockets 160 and support elements 166, are all removed from the support sleeve 135, as illustrated in FIG. 7. The backboard 144 is then rotatably moved to a position that locates the axis of the hoop 156 in spaced relation with respect to the axis of the support member 132, as illustrated in phantom in FIG. 7, so as to provide for safe play of the game. In order to provide for the movement of the backboard 144 to the position shown in phantom in FIG. 7, the lock pins 148 are first lifted from engagement with the bracket 146 and plate 140 and the backboard is then swiveled relative to the post 142 to the position shown in phantom in FIG. 7. In this position, the axis of the hoop 156 is disposed in a position that is offset with respect to the axis of the support member 132. The lock pins 148 are then re-inserted into bracket 146 in the locked position, also shown in phantom in FIG. 7, to fix the backboard 144 in its swiveled position. With the backboard 144 and the hoop 156 as now located in offset relation with respect to the support member 132, a safe play of the game can be carried out since the support member 132 will not interfere with normal activity during play of the game.

In both forms of the apparatus as disclosed above in FIGS. 1–5, and in FIGS. 6–8, it is desirable when the apparatus is utilized for practice purposes to record the performance of a player at any specific location in the shooting area. Thus, shots taken from a designated position are recorded by an electronic counter 198 located at the ball stop on the outermost end of the ramp that is actuated when a ball is lifted from the ball stop. A similar electronic counter 200 having a detecting arm 202 is placed in proximity to the hoop mounted on the backboard for recording successful shots through the hoop. Suitable circuitry in the counters can be employed to visually display the recorded information or, if desired, the data can be stored for retrieval, and for obtaining a permanent record. Although not specifically illustrated a proximity sensor may be mounted on either of the fixed tubes 74 that would detect the distance from the sensor to a player located behind the end member 78 which in effect will determine the distance from the player to the backboard 40. The data obtained from the results of the shots taken by a player would then be used to arrive at a shooting percentage at various floor locations from which the player takes a shot or series of shots. By compiling the statistical data, the results in the form of a readout would be obtained for profiling a player's shooting proficiency at various preselected locations. By understanding the weaknesses and strengths of a player's outside shooting ability with respect to certain floor areas, the shooting ability of individual players can best be utilized under playing conditions.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. Basketball apparatus, comprising a support member, a backboard mounted on said support member, a hoop mounted on said backboard in fixed position and in coaxial relation with respect to said support member and means interconnecting said backboard to said support member for rotatably moving said backboard and hoop fixed thereto relative to said support member, wherein said hoop is retained in coaxial relation with respect to said support member during the rotatable movement of said backboard and hoop, said backboard being locatable in various selected angular positions with respect to a predetermined location that is disposed remote from said support member and said backboard member and hoop mounted thereon, thereby enabling a player to shoot a basketball at the hoop and backboard without changing location, but simulating various angle shots that are experienced in the actual play of the game.

2. Basketball apparatus as claimed in claim 1, including means for rotating said backboard 180° from a first position to a second position relative to said support member, wherein said hoop is disposed in non-axial vertical alignment with said support member.

3. Basketball apparatus as claimed in claim 2, said support member being disposed in a fixed position.

4. Basketball apparatus as claimed in claim 2, said rotating means including a sleeve mounted for rotation on said support member, and an inclined arm joined to said sleeve and being interconnected to said backboard for supporting said backboard for rotary movement on said support member from said first position to said second position.

5. Basketball apparatus as claimed in claim 2, said first position of said backboard in which said hoop is located co-axially with respect to said support member defining a position in which the apparatus is used primarily for practice, and said second position of said backboard defining a position in which the apparatus is used primarily for play of the game.

6. Basketball apparatus as claimed in claim 1, a cage assembly mounted on said support member, said cage assembly having a screen assembly mounted thereon and enveloping said backboard and hoop, said cage assembly being open at the top and front thereof to permit practice shooting at the hoop at a position remote therefrom, and means located adjacent to said support member and extending outwardly therefrom, and being substantially enclosed by said screen assembly to define a ball return device for directing a basketball that is shot at the hoop and captured by said cage assembly for return to a player located at the outermost end of said ball return device.

7. Basketball apparatus as claimed in claim 6, said ball return device including an inclined elongated chute located below said hoop and being enclosed by said cage and screen assemblies, means interconnected to said chute and said support member for supporting said chute in the inclined position thereof, and a ramp member connected to said chute and extending outwardly therefrom, and having a ball return stop mounted thereon for receiving a ball that is shot by a player toward said hoop and that is directed by said cage and screen assemblies to said ball return device.

8. Basketball apparatus as claimed in claim 1, said support member including a turret assembly having a collar mounted on the uppermost end of said support member and being rotatable relative thereto, said interconnecting means including an inclined arm that is joined to said collar and that is movable therewith, said inclined arm being fixed to said backboard at the rear thereof, and adjustment means interconnected to said collar for rotating said collar with respect to said support member to produce a corresponding movement of said backboard for locating said backboard and hoop mounted thereon in a selected angular position of use.

9. Basketball apparatus as claimed in claim 8, said adjustment means including a gear joined to said collar, and a motor mounted on said support member, and being interconnected to said gear for selectively rotating said gear to adjust the angular position of said backboard relative to said support member.

10. A method of practice shooting basketballs at a backboard and a hoop mounted on a support member said hoop member being disposed in coaxial position with respect to said support member, wherein said backboard and hoop are rotatable relative to said support member while said hoop is retained in coaxial relation with respect to said support member, comprising the steps of shooting the basketball from a preselected position that is remote from said backboard and hoop, and selectively rotating said backboard to vary the angular relation therebetween and said preselected position while said hoop remains in coaxial position relative to said support member, so that a player located at said preselected position will have a variety of angular shots at said backboard and hoop that simulates shots taken under actual playing conditions.

11. A method of practice shooting basketballs as claimed in claim 10, comprising the further step of recording the number of shots taken and the number of shots entering the hoop, wherein the ratio of shots entering the hoop to the number of shots taken are recorded for analyzing the proficiency of the player.

12. A method as claimed in claim 11, moving the location from which the shots are taken to other preselected locations and automatically recording the number of shots taken and number of shots made, wherein a proficiency profile is obtained for the player in which the most proficient location for the player is determined.

13. Basketball apparatus, comprising a support member, a backboard mounted on said support member, a hoop mounted on said backboard and means interconnecting said backboard to said support member for rotatably moving said backboard relative to said support member, wherein said backboard is locatable in various selected angular positions with respect to a predetermined location that is disposed remote from said support member and said backboard member mounted thereon, thereby enabling a player to shoot a basketball at the hoop and backboard without changing location, but simulating various angle shots that are experienced in the actual play of the game, means for rotating said backboard 180° from a first position to a second position relative to said support member, wherein said hoop is disposed in non-axial vertical alignment with said support member, said rotating means including a sleeve mounted for rotation on said support member, an inclined arm joined to said sleeve and being interconnected to said backboard for supporting said backboard for rotary movement on said support member from said first position to said second position, a vertical post joined to the outermost end of said inclined arm, means for rotatably securing said backboard to said vertical post wherein said backboard is rotatable on said vertical post to and from the first and second positions thereof, and means for locking said backboard in either the first or second positions.

14. Basketball apparatus, comprising a support member, a backboard mounted on said support member, a hoop mounted on said backboard and means interconnecting said backboard to said support member for rotatably moving said backboard relative to said support member, wherein said backboard is locatable in various selected angular positions with respect to a predetermined location that is disposed remote from said support member and said backboard member mounted thereon, thereby enabling a player to shoot a basketball at the hoop and backboard without changing location, but simulating various angle shots that are experienced in the actual play of the game, a cage assembly mounted on said support member, said cage assembly having a screen assembly mounted thereon and enveloping said backboard and hoop, said cage assembly being open at the top and front thereof to permit practice shooting at the hoop at a position remote therefrom, and means located adjacent to said support member and extending outwardly therefrom, and being substantially enclosed by said screen assembly to define a ball return device for directing a basketball that is shot at the hoop and captured by said cage assembly for return to a player located at the outermost end of said ball return device, said ball return device including an inclined elongated chute located below said hoop and being enclosed by said cage and screen assemblies, means interconnected to said chute and said support member for supporting said chute in the inclined position thereof, a ramp member connected to said chute and extending outwardly therefrom and having a ball return stop mounted thereon for receiving a ball that is shot by a player toward said hoop and that is directed by said cage and screen assemblies to said ball return device, said chute being pivotally mounted on the supporting means therefor for movement to a storage position, and said chute and ramp being pivotally interconnected to permit the folding thereof to a storage position.

15. Basketball apparatus as claimed in claim 14, a slide member being mounted on said support member and being vertically movable therewith, said slide member being interconnected to said cage and screen assemblies, and being movable downwardly on said support member to a storage position when said chute and ramp are folded to the storage position thereof.

16. Basketball apparatus, comprising a support member, a backboard mounted on said support member, a hoop mounted on said backboard and means interconnecting said backboard to said support member for rotatably moving said backboard relative to said support member, wherein said backboard is locatable in various selected angular positions with respect to a predetermined location that is disposed remote from said support member and said backboard member mounted thereon, thereby enabling a player to shoot a basketball at the hoop and backboard without changing location, but simulating various angle shots that are experienced in the actual play of the game, said support member including a turret assembly having a collar mounted on the uppermost end of said support member and being rotatable relative thereto, said interconnecting means including an inclined arm that is joined to said collar and that is movable therewith, said inclined arm being fixed to said backboard at the rear thereof, and adjustment means interconnected to said collar for rotating said collar with respect to said support member to produce a corresponding movement of said support member to produce a corresponding movement of said backboard for locating said backboard and hoop mounted thereon in a selected angular position of use, said adjustment means including a gear joined to said collar, a motor mounted on said support member, and being interconnected to said gear for selectively rotating said gear to adjust the angular position of said backboard relative to said support member, a base on which said support member is mounted, a tubular slide member mounted on said support member in vertical sliding relation with respect thereto, said collar being mounted on said tubular slide member for rotating movement relative thereto and being vertically movable therewith on said support member, spaced support rods, one end of which are joined to said tubular slide member and the other end of which are joined to a screen for supporting the screen in enveloping relation around said backboard and said hoop, and motor means mounted on said base and interconnected to said tubular slide member for vertically moving said backboard, hoop and said cage and screen assemblies to and from a position of use and a storage position.

17. Basketball apparatus as claimed in claim 16, said base including spaced legs on which wheel members are mounted, wherein said apparatus is easily movable on a surface to selected positions of use or storage.

18. Basketball apparatus as claimed in claim 16, case assembly support rods interconnected to said slide member and said cage assembly for supporting said cage assembly and being disposed in inclined relation, netting joined to said cage assembly and defining a funnel into which a ball is directed after being shot at the hoop, and a ball return device located below said funnel for receiving the ball as directed thereto by said funnel, said ball return device including an inclined chute and ramp onto which the ball is directed, said chute and ramp extending outwardly from said support member for directing the ball to an outer stop position for reshooting by a player located thereat.

19. Basketball apparatus, comprising a support member, a backboard mounted on said support member, a hoop mounted on said backboard and means interconnecting said backboard to said support member for rotatably moving said backboard relative to said support member, wherein said backboard is locatable in various selected angular positions with respect to a predetermined location that is disposed remote from said support member and said backboard member mounted thereon, thereby enabling a player to shoot a basketball at the hoop and backboard without changing location, but simulating various angle shots that are experienced in the actual play of the game, means located at the position remote from said backboard for receiving a basketball thereat, means disposed at said receiving means for detecting the removal of said basketball therefrom for indicating a shot taken with said basketball, means located adjacent to said hoop for detecting a successful shot through said hoop, and means for recording the number of shots taken and number of shots made for calculating the proficiency of a player in making shots.

20. Basketball apparatus as claimed in claim 19, means for sensing the distance of the player from said backboard, and means for calculating and recording the proficiency of a player's shooting ability at a plurality of locations relative to the angular position of the backboard and the distance therefrom.

* * * * *